United States Patent [19]

Handa

[11] Patent Number: 4,687,458

[45] Date of Patent: Aug. 18, 1987

[54] CAP PLUG FOR A BALLOON

[75] Inventor: Koichiro Handa, Hakodate, Japan

[73] Assignee: Handa Kikai Kigu Kabushiki Kaisha, Hokkaido, Japan

[21] Appl. No.: 907,518

[22] Filed: Sep. 15, 1986

[51] Int. Cl.[4] ..... A63H 3/06

[52] U.S. Cl. ..... 446/222; 446/220; 446/224

[58] Field of Search ..... 446/222, 220, 221, 223, 446/224; 141/313; 24/590; 411/554

[56] References Cited

U.S. PATENT DOCUMENTS

| | | | |
|---|---|---|---|
| 2,859,932 | 11/1958 | Mackal | 446/222 |
| 2,862,531 | 12/1958 | Walker | 446/220 |
| 2,924,041 | 2/1960 | Jackson et al. | 446/224 |
| 3,871,422 | 3/1975 | Elson et al. | 446/222 |
| 4,094,347 | 6/1978 | Ikemoto | 446/220 |

*Primary Examiner*—Victor N. Sakran

*Attorney, Agent, or Firm*—Sherman and Shalloway

[57] ABSTRACT

Disclosed is a cap plug for a balloon which includes a body mounted on a mouth portion of a balloon, an attachment connected to the body through a detachable connecting means and a yarn for connecting the body and the attachment. The connecting means has four outwardly directed engaging pawls provided on the body and an engaging groove provided in the attachment and engageable with the engaging pawls. The desired connection is achieved by moving each of the engaging pawls into the corresponding engaging groove, and relatively rotating the attachment and the body to bring the engaging pawl into firm engagement with the engaging groove. The engagement between the body and the attachment is released by rotation thereof in a direction opposite to that when they are connected.

6 Claims, 8 Drawing Figures

CAP PLUG FOR A BALLOON

BACKGROUND OF THE INVENTION

1. Field of the Invention

This invention relates to a cap plug provided with a check valve, which is mounted on a toy or a balloon for advertisement interiorly sealed with gases such as air, hydrogen or helium, and more particularly to a cap plug having a construction suitable for an automatic supplying machine or a vending machine for balloons.

2. Description of the Prior Art

A conventional cap plug construction of this kind is shown in FIG. 7.

In FIG. 7, a reference numeral 1 designates a rubber balloon body and 2 designates a cap plug. The cap plug 2 is composed of a cylindrical closed-end cap body 3 pressed into a mouth portion of the balloon body 1 through a check valve and vent hole 4, and a hanging and exhibiting guide and grip portion 5 provided integrally with an open leading edge of the body 3 through a connecting member 15 that may be cut off by means of a cutter. An annular rib 6 is formed integrally with the outer periphery on the front end of the body 3. The rib 6 causes the mouth portion of the rubber balloon 1 to be pressed into engagement to prevent the mouth portion from being slipped out.

The guide and grip portion 5 has an annular spool groove 7 formed in the outer periphery in the neighbourhood of the separable connecting member 15 and an annular guide groove 8 formed in the outer periphery at a position adjacent to the spool groove 7.

A length of thread 9 is wound about the spool groove 7 to provide a linkage between the body 3 and the guide and grip portion 5.

In the conventional constrcution of the cap plug as described above, the body 3 is pressed into the mouth portion of the balloon body 1, and the end of the mouth portion is brought into engagement with the annular rib 6 of the body 3. In this state, the guide groove 8 of the guide and grip portion 5 is slidably fitted and held between parallel guide rails 10 (see FIG. 4) provided on the vending machine thereby to hang a plurality of balloons 1 adjacent to each other within the vending machine.

When the balloons are supplied, a gas injecting nozzle is automatically inserted into the body 3 to inject a compressed gas. The gas is then injected into the body 1 through the vent hole 4 of the body 3 whereby the body 1 in inflated to a predetermined volume. When pressure is released, the inner surfaces of the balloon block the vent hole 4 to prevent the gas from being excaped.

Next, the connecting member 15 between the body 1 and the guide and grip portion 5 is automatically cut and separated by a cutter provided on the vending machine to be supplied to an outlet.

In the conventional construction of the cap plug, the body 3 and the guide and grip portion 5 are of an integral construction through the separable connecting member 15. When the balloons are supplied or sold, the connecting member 15 has to be automatically cut otherwise the body 1 cannot be separated from the guide and grip portion 5. This leads to a problem that sales of balloons is merely made by a specific vending machine provided with an automatic cutter, and for example, the balloons cannot be sold in bulk at stores.

This invention has been accomplished in order to solve the problem noted above. An object of the invention is to provide a cap-plug constructin of a balloon which can be easily separated without cutting the cap plug body and the guide and grip portion.

SUMMARY OF THE INVENTION

In a cap plug of a balloon according to this invention, a cylindrical closed-end cap-plug body having a vent hole in the peripheral wall and a guide and gripping attachment having a hanging guide groove in the outer periphery are individually formed, a plurality of outwardly directed engaging pawls are integrally formed on the open end edge of said cap plug body, and said attachment includes an annular engaging groove along the inner peripheral surface and a cut guide portion partly connected to the annular engaging groove and from which said pawl is disengaged whereby the cap plug body and the attachment may be connected by means of a length of thread.

According to the present invention, the cap plug body is pressed into the mouth portion of a balloon, the outwardly directed engaging pawl of the attachment is fitted into the annular engaging groove of the cap plug body through the cut guide portion, after which when the attachment is rotated, the engaging pawl is displaced from the cut guide portion and fitted in and engaged with the annular engaging groove.

When the balloons are set in the vending machine in the aforesaid state, the guide groove in the outer periphery of the attachment is slidably fitted in and held by the guide rail of the vending machine.

When the balloons are sold, the gas injecting nozzle is automatically inserted into the cap plug body, and the gas is injected from the nozzle into the balloon to inflate the rubber balloon to a predetermined volume. Then, the balloon is supplied to the outlet of the vending machine.

When a client turns or rotates the attachment to a position where the outwardly directed engaging pawl of the cap plug body registers with the cut guide portion and pulls out the attachment, the cap plug body is separated from the attachment and the balloon rises.

According to another aspect of the invention, the cap plug having the above-described construction further comprises a pair of joints capable of being connected and separated from each other, said joints being provided at positions where the outer peripheral surfaces of the attachment are opposed. Preferably, one joint has a shape of a ring having a slit whereas the other joint has a hook-like shape engageable with the ring. The hook of the cap plug is engaged with the ring of the other plug arranged adjacent thereto whereby two plugs are connected each other with their axes being substantially parallel. A train composed of a plurality of cap plugs thus connected provides excellent advantages when a number of cap plugs are carried. Furthermore, operation becomes easy to set a predetermined number of plugs to a vending machine. The slit formed in the ring facilitates disengagement of the hook from the ring when two plugs connected each other are separated. Thus, by merely applying a strong pull to the plug from the rail of the vending machine, it is poissible to release connection between said plug and a plug adjacent thereto.

DETAILED DESCRIPTION OF THE PREFERRED EMBODIMENTS

Figure 1:
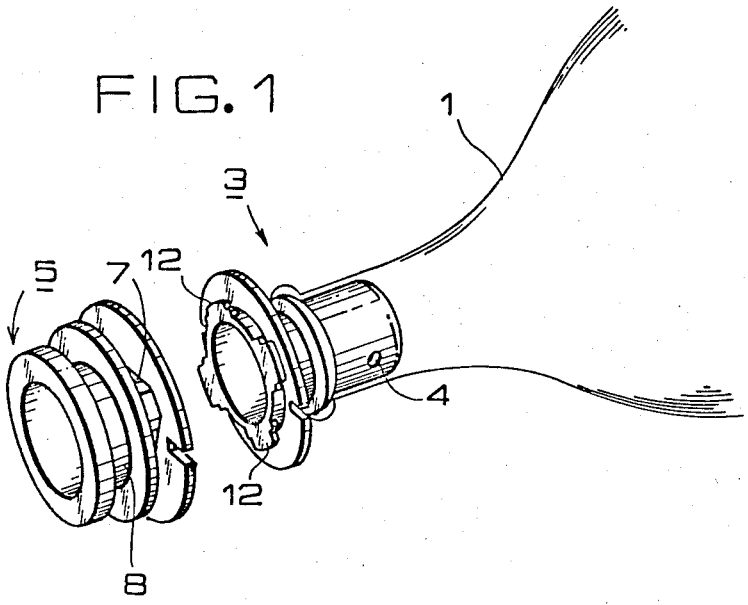
FIG. 1 is a perspective view of a cap plug according to the present invention with its body separated from an attachment.
Figure 7:
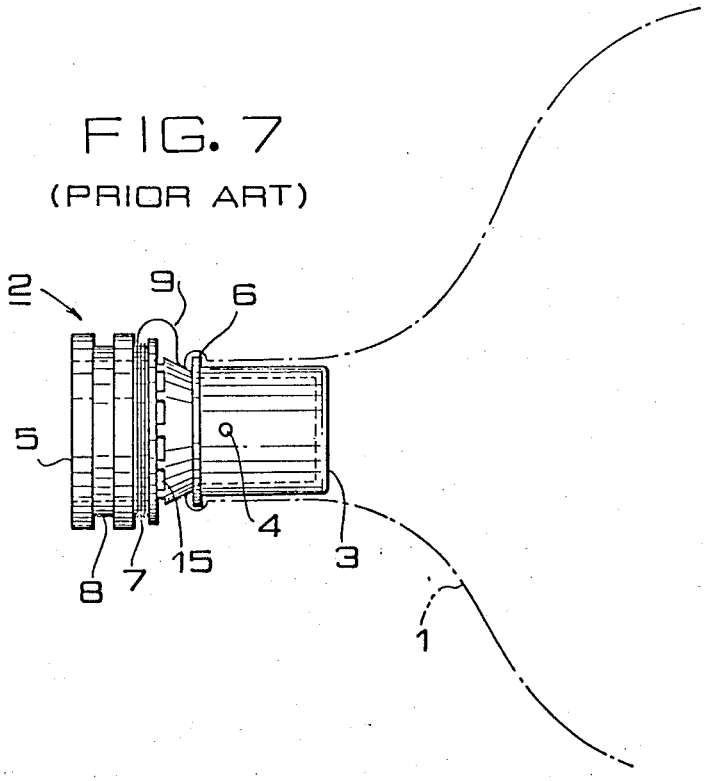
FIG. 7 (PRIOR ART)
FIG. 7 is a crosses sectional view showing a conventional cap plug.

One embodiment of the present invention will be described in connection with FIGS. 1 through 3, in which elements of the same as or corresponding to those of prior art are indicated at the same reference numerals, and the same arrangement as that of prior art will not be described.

A cap plug body 1 integrally formed into a closed-end cylindrical configuration from a synthetic resin has in its outer peripheral surface on the open end side an annular outer collar 11 and an annulr rib 6 positioned in the vicinity of the collar 11. The body 3 is further provided with a vent hole 4 in the peripheral wall thereof.

The body 3 is integrally formed in its open edge at the front end thereof with a plurality of, for example, four outwardly directed engaging pawls 12 in a predetermined spaced relation.

A substantially cylindrical attachment serving as a guide and a grip is formed separately from the body 3 from the same synthetic resin as that of the body 3.

The attachment 5 is detachably fitted into and engaged with the body 3. The attachment 5 includes a second outer collar 16 face to the outer collar 11 of the body 3 when the attachment is fitted, an annular spool groove 7 formed on the front portion of the outer collar 16 and a hanging guide groove 8 formed at a position adjacent to the groove 7.

The attachment 5 is formed with an engaging groove 13 along the inner peripheral surface, and a cut guide portion 14 along the groove 13. The pawl 12 is inserted into and removed from the guide 14.

The body 3 and the attachment 5 are cooperated by a length of thread 9, which is wound in the groove 7 of the attachment 5.

The body is pressed into a mouth portion of a rubber balloon 1, and the outwardly directed engaging pawl 2 of the attachment 5 is fitted into the engaging groove 13 of the body 3 through the guide portion 14. Therefter, the attachment 5 is rotated. Then, the pawl 12 is displaced from the guide portion 14 and fitted into and engaged with the groove 13.

In this state, the balloon may be set in a conventional vending machine. In this case, the guide groove 8 in the outer periphery of the attachment 5 is slidably fitted in held by the guide rail 10 of the vending machine (FIG. 4).

When the balloon is sold, a gas injecting nozzle (not shown) is inserted into the body 3 through the attachment 5. The gas is injected from the nozzle into the balloon 1 to inflate the rubber balloon 1 to a predetermined volume. Then the balloon 1 is supplied to the outlet of the vending machine. This operation is automatically made in response to the charging of a coin.

Figure 4:
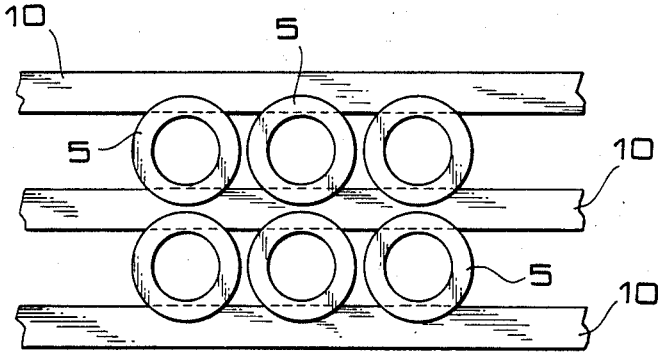
FIG. 4 shows a cap plug supported on the rail of a balloon vending machine.

After the balloon with a cap plug has been removed from the vending machine, the client rotates the attachment about one forth ($\frac{1}{4}$) to a position where the pawl 12 of the body 3 registers with the guide portion 14. When the attachment is pulled out, the body 3 is separated from the attachment 5 to raise the rubber balloon 1. Preferably, it is designed so that the pawl 12 and the groove 13 are detachably pressed and engaged with each other by rotating the attachment 5 relative to the body 3, for example, one forth ($\frac{1}{4}$) in a one direction, which means is obvious for those skilled in the art.

Where a plurality of cap plugs are set in a row on the guide rail of the vending machine as shown in FIG. 4, it is preferable that the plugs are connected with one another in the form of a train because a transportation and an operation of setting balloons to the vending machine are facilitated. This invention provides a cap plug provided with a means for connection as described above.

Figure 2:
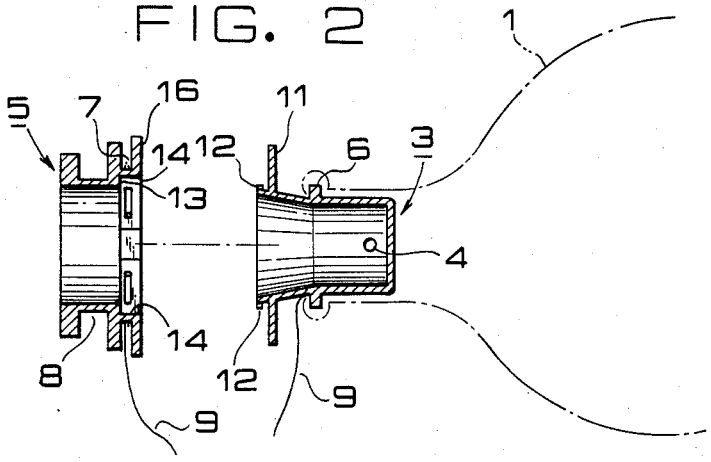
FIG. 2 is a cross sectional view of the cap plug shown in FIG. 1.
Figure 3:
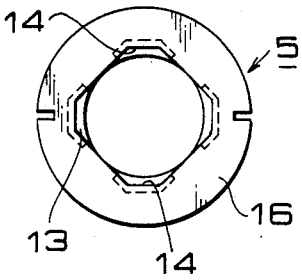
FIGS. 3 (A) and 3 (B) are respectively side views of the cap plug shown in FIG. 1 with the attachment opposed to the body.
Figure 3:
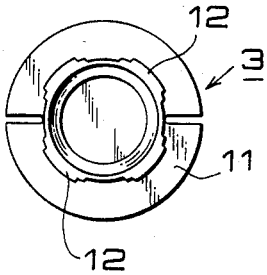
Figure 5:
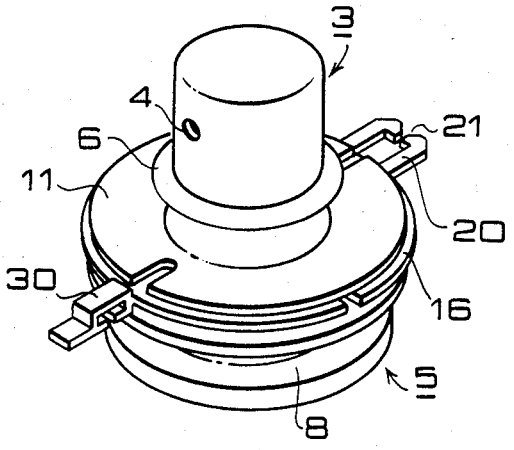
FIG. 5 is a perspective view showing a further cap plug according to the present invention.
Figure 6:
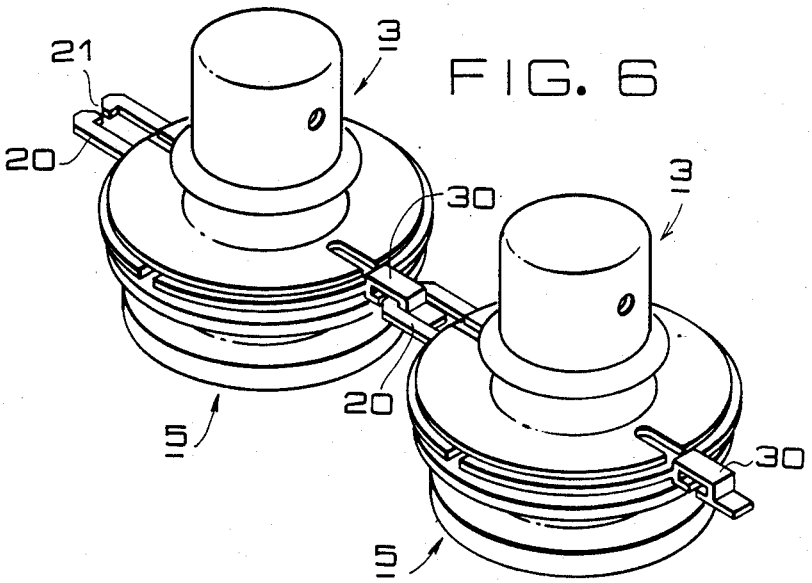
FIG. 6 shows two cap plugs shown in FIG. 5, which are connected with each other.

Referring to FIG. 5, a cap plug composed of a body 3 and an attachment 5 having substantially the same structure as those shown in FIGS. 1 to 3 further includes a set of joint members 20 and 30 which are integrally formed at a position where outer peripheral edges of an outer collar 16 are opposed. The first joint member 20 is substantially in the form of a rectangular ring, and has an annular discontinuous slit 21 at a portion most away from the outer collar 16. The second joint member 30 is in the form of a hook having a dimension that may be engaged with the first joint member 20. The second joint member 30 engages the first joint member 20 adjacent thereto as shown in FIG. 6 whereby two cap plugs arranged so that axes thereof are substantially in parallel with each other may be connected together. All the adjacent cap plugs are connected in a manner similar to that described above, a train is formed in which a desired number of cap plugs are disposed in a row.

The slit 21 formed in the first joint member 20 is enlarged to the size so that when mutually connected two cap plugs are strongly pulled apart, the first joint 20 is deformed and the second joint 30 may be passed. Thereby the connection between the joint members 20 and 30 is released. Such a pull-apart force required to release the connection has a magnitude imparted by a mechanism wherein the vending machine causes the foremost cap plug to be advanced along the guide rail.

What is claimed is:

1. A cap plug for a balloon, comprising a substantially cylindrical body having one end closed;

said body having a vent hole provided at a position close to the closed one end and extending through a peripheral wall thereof and a plurality of outwardly directed engaging pawls formed on the foremost end of an open end;

a substantially cylindrical attachment arranged coaxial with said body and having at one end an engaging means which disengageably engages said engaging pawls;

said engaging means having a cut guide having a configuration in coincidence with said engaging pawl, and an engaging groove wherein said engaging pawl is within said cut guide, said body is rotated relatively to said attachment whereby said engaging groove engages said engaging pawls to connect said body and said attachment each other; and a length of thread having a predetermined length one end of which is secured to said body and the other end secured to said attachment.

2. The cap plug as set forth in claim 1, wherein four outwardly directed engaging pawls are provided.

3. The cap plug as set forth in claim 1, wherein said body and said attachment respectively have an annular outer collars which are faced to each other and in contact with each other in the state where they are connected each other in a predetermined relation.

4. The cap plug as set forth in claim 1, wherein said attachment includes a first and a second joint members at an opposed position on the outer peripheral surface thereof, said joint members being engaged with each other in such a manner that they may be separated when being pulled apart.

5. The cap plug as set forth in claim 4, wherein said first joint is in the form of a ring, and said second joint is in the form of a hook engageable with said ring.

6. The cap plug as set forth in claim 5, wherein said ring has a slit for facilitating the disengagement of said hook being engaged with said ring.

* * * * *